United States Patent [19]

De Filippi

[11] Patent Number: 4,877,366

[45] Date of Patent: Oct. 31, 1989

[54] REFUSE VEHICLE

[76] Inventor: Quinto De Filippi, 29 Edenvalley Drive, Islington, Ontario, Canada

[21] Appl. No.: 184,668

[22] Filed: Apr. 22, 1988

[51] Int. Cl.[4] ..... B65F 3/28

[52] U.S. Cl. ..... 414/517; 414/525.6; 414/511; 137/355.20; 298/23 M; 298/23 MD; 100/269 B; 100/229 R

[58] Field of Search ..... 414/509, 510, 511, 512, 414/513, 514, 515, 516, 517, 525 R, 492, 493, 525.6; 298/23 M, 238, 23 MD; 100/229 R, 229 A, 269 R, 269 B; 137/355.16, 355.20, 355.23, 355.28

[56] References Cited

U.S. PATENT DOCUMENTS

| | | | |
|---|---|---|---|
| 2,934,226 | 4/1960 | Dempster et al. | 414/517 |
| 3,661,170 | 5/1972 | Mitchell | 137/355.2 X |
| 3,861,117 | 1/1975 | DeFilippi . | |
| 3,917,328 | 11/1975 | DeFilippi . | |
| 4,544,320 | 10/1985 | Haines | 414/517 |
| 4,576,540 | 3/1986 | Derain et al. | 414/517 X |
| 4,627,783 | 12/1986 | De Filippi | 414/517 |

FOREIGN PATENT DOCUMENTS

| | | | |
|---|---|---|---|
| 3447814 | 7/1986 | Fed. Rep. of Germany | 414/517 |

*Primary Examiner*—Frank E. Werner

[57] ABSTRACT

A refuse vehicle body of the type having a tailgate which may be raised to eject the contents, and a forward opening in the main body through which refuse may be dumped, and a ram moveable from the forward opening to the tailgate, and having a moveable bridge member extending from side to side of the main body; a compacting cylinder coupled to the bridge, and connected with the ram member for compacting refuse, and an ejection cylinder connected to the main body and to the bridge for moving the bridge rearwardly for ejecting contents from the main body.

5 Claims, 4 Drawing Sheets

REFUSE VEHICLE

The invention relates to a refuse disposal vehicle of the type having a front end loading device, and a hopper, with a compactor, and a rear door for dumping of the contents.

BACKGROUND OF THE INVENTION

Bulk loading refuse disposal vehicles are well known. Such refuse vehicles have a front end loading device for lifting a bulk container, and have a hopper mounted on the vehicle body for receiving the contents of the container. At the rear end of the hopper there is a door which can be released to dump the contents at a dump.

Within the hopper there is a ram, which is adapted to pack and compress the contents towards the rear of the hopper.

Typically these refuse vehicles are operated by private owners, who undertake collection of refuse, typically at commercial sites, for a contract price.

Usually the dump site will be at some distance from the locations where refuse will be picked up. Consequently, a large part of the driver's time will be occupied in driving to and from the dump site, and dumping the contents.

Clearly, therefore, it is advantageous from the viewpoint of economy of operation if the hopper can carry the largest possible payload. In this way the driver will be able to serve a larger number of customers, before being obliged to drive to the dump site and unload.

Various factors affect the size of the payload.

The overall volume of the hopper is a prime consideration. Clearly, there are dimensional limits on the height and width to which the hopper can be constructed. The only practical way in which the hopper can be increased in volume is by increasing its length. However, there are also practical limits on the length of the hopper. In the majority of cases the rams for compacting the contents are operated by means of hydraulic cylinders. In some cases the ram is used to eject the contents at the dump site. In other cases a form of tipping action is provided, and separate hydraulic cylinders are installed which tip the body so that the contents slide out of its own weight. If a tipping body is adopted, then it is impractical to extend the length of the body to any extent, since the longer the body the more difficult it becomes to tip. On the other hand, if the compacting ram itself is used for ejecting the contents, then the length of the cylinders operating the ram impose limitations on the length of the body. Multi-cylinder telescopic cylinders have been proposed for operating the ram, but they are not always as reliable as simple cylinders. In addition, they tend to require more power for their operation, and consequently consume more fuel, due to the greater volume of the larger diameter cylinders in a set of telescopic cylinders. They are also somewhat slower to operate, than simple cylinders. A further fact which affects the total payload that can be packed in any given container is the force used in compacting. Clearly, the greater the force that can be applied to the payload, the more its volume will be reduced and the greater the payload will be, within the same space.

BRIEF SUMMARY OF THE INVENTION

With a view to meeting these various conflicting requirements, the invention comprises a refuse vehicle body of the type having a generally rectangular main body, a tailgate body portion which may be raised to eject the contents, and a forward opening in the main body through which refuse may be dumped, and a ram member movable through said main body, from said forward opening to said tailgate, for compacting refuse, and for subsequently ejecting refuse from said main body and being characterized by: a movable bridge member extending from side to side of said main body, slide means in said main body for cooperation with said bridge member, for permitting sliding movement of said bridge member along said main body between a forward compacting position and a rearward ejecting position, compacting cylinder means coupled to said bridge member, and connected with said ram member, said compacting cylinder means being operable to move said ram member relative to said bridge member along said main body for compacting refuse in said main body and in said tailgate portion, ejection cylinder means connected to a forward portion of said main body, and to said bridge member, for moving said bridge member away from said forward portion of said main body towards said tailgate portion, for ejecting contents from said main body.

More particularly, the invention seeks to provide a refuse vehicle body having the foregoing advantages wherein said compacting cylinder means comprises left and right hand cylinders connected to opposite ends of said bridge member and connecting diagonally across said main body, with respective left and right hand corners of said ram member, and said right and left hand cylinders being pivotally mounted both to said bridge member and to said ram member, whereby said cylinders same may swing relative thereto, and including storage compartment means in said bridge member for receiving portions of said cylinders, when said ram member is in its retracted position.

More particularly, it is an objective of the invention to provide a refuse vehicle body having the foregoing advantages wherein the ejection cylinder means comprises a multi-cylinder telescopic cylinder mounted centrally, along a central axis of said main body, and operable to extend said bridge member towards said tailgate portion, for ejection of refuse.

More particularly, it is an objective of the invention to provide a refuse vehicle body having the foregoing advantages including flexible hydraulic hose means connecting with said compacting cylinders, and including hose support means defining at least two hose support portions hingedly connected to one another, and swingably connected respectively to said main body, and to said bridge member, whereby to provide a movable support means for said flexible hoses during movement of said bridge member.

More particularly, it is an objective of the invention to provide a refuse vehicle body having the foregoing advantages including tailgate cylinders, operable to raise and lower said tailgate portion relative to said main body, locking abutments on said main body, and locking arm means on said tailgate portion movable into and out of locking engagement with said locking abutments, and linkage means connecting said locking arm means with said tailgate cylinders, for operation thereof in unison with operation of said tailgate cylinders.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
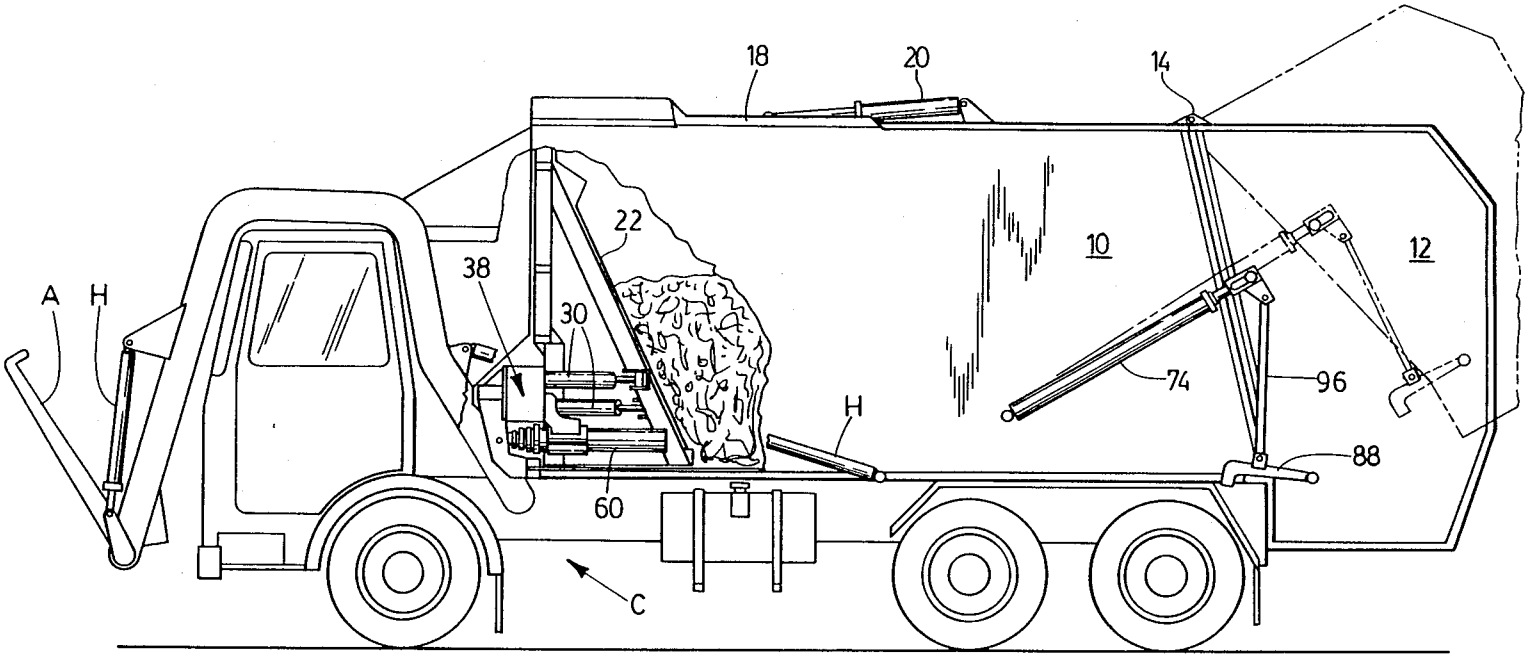
FIG. 1 is a side elevational view partially in section showing a typical refuse vehicle, with a refuse vehicle body in accordance with the invention mounted thereon.

Referring now to FIG. 1, the invention will be seen to comprise a refuse vehicle body indicated generally as 10 mounted on a typical refuse vehicle chassis indicated generally as C.

Such vehicles are available from many manufacturers and form no part of the present invention, being merely illustrated here for the sake of completeness. Typically they employ a main engine and drive train, and the main engine may also drive a separate hydraulic pump, through suitable hydraulic controls, the details of which are well known in the art and require no further description. In this way the main engine of the vehicle is used for operating the various hydraulic systems to be described below.

It will of course be appreciated that the operation of such hydraulic systems is dependent on the forces required to be developed, and also the volumes of hydraulic fluid required to be moved in order to achieve work. Clearly, from the viewpoint of economy in the operation of the main engine, both in fuel consumption, and in wear and tear, it is desirable that the design and operation of the hydraulic circuit shall be optimized to the point where fuel consumption and engine wear are reduced to a minimum. In the past however this has not always been achieved. In many cases, multi-cylinder telescopic cylinder systems have been employed for both packing and for ejecting. These systems involve the use of hydraulic cylinders of a progressively increasing diameter, and thus progressively increasing volume. In fact, the diameter of the larger cylinders in such telescopic systems is frequently much greater than that required to develop the necessary compacting forces. Nonetheless, in order to operate such a telescopic cylinder system for compacting, it was necessary for the main engine to pump unnecessarily large volumes of hydraulic fluid, causing excessive fuel consumption and unnecessary engine wear, and noise. Since compacting is carried out many times for each load, whereas ejecting is carried out only once, this represented a major source of expense, and took up considerable time.

In accordance with the present invention the solution to this problem is in principle to provide two different hydraulic cylinder systems, namely a packing system and an ejecting system, as will be described in more detail below.

Referring now to FIGS. 1, 2, 3 and 4, the preferred embodiment of the invention is illustrated in the form a generally rectangular main container body, or hopper 10, and a movable tailgate portion 12 hinged along its upper edge as at 14. When the tailgate is open, the entire rear end of the main body 10 is open for ejection of its contents.

At the forward end of the main body portion 10 adjacent the cab of the vehicle, there is a filling opening 16 in the roof of the main body, closed by means of a movable door 18, and operated by a cylinder 20. Within the main body portion 10, there is a packing ram member 22, arranged in a generally forwardly sloping manner from bottom to top, so that at least the top edge of the packing ram 22, when it is in its retracted position, clears the filling opening, to allow for filling of refuse.

Typically, filling of refuse will be achieved by means of a pair of lifting arms indicated generally as A extending forwardly of the vehicle, and operated by hydraulic means H, for lifting a container (not shown) of refuse upwardly and then dumping it into the opening.

The details of such front end loading mechanisms are well known in the art, and further description is omitted for the sake of simplicity.

The ram or packer 22 is guided, along its lower side edges, by means of guide rails 26 located on either side of main body 10. Rails 26 receive guide flanges 28 extending outwardly on either side of ram 22. Wear pads 29 are provided on flanges 28, and are replaceable.

In order to provide sufficient packing force to operate the ram 22, two simple hydraulic cylinders 30—30 are provided. Cylinders 30 are arranged in a diagonal criss-cross fashion each having piston rods 32—32. The forward ends of the piston rods 32—32 are attached by means of pivot mountings 34—34 to the lower corners of the ram 22. The respective cylinders 30 are connected by pivot joints 36—36 to a transverse supporting bridge 38.

Bridge 38 is slidably mounted within main body 10, by means of slide flanges 40—40 on either side thereof. Flanges 40 have replaceable wear pads 41 which engage the guide rails 26 mounted within the main body, for guiding the ram 22, as described above.

Bridge 38 is formed with a lower wall portion 42, and upstanding side walls 44—44, an intermediate wall 45, and a top wall 46 extending transversely therebetween.

Top wall 46 and intermediate wall 45 are joined more or less at their mid-point by a diagonal wall portion 46a.

Between the lower wall and the intermediate wall, and the top wall, there are defined lower and upper cylinder recesses 48 and 50, respectively.

The recesses 48 and 50 are open towards the rear of the main body 10, and are closed forwardly by means of generally diagonal walls 52 and 54.

Figure 4:
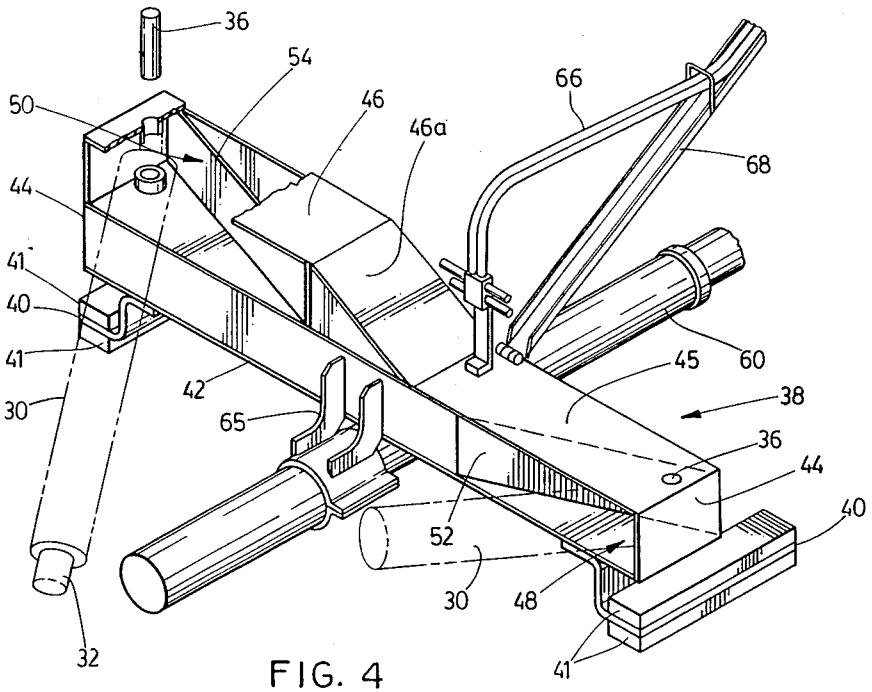
FIG. 4 is a perspective of the bridge showing the compacting cylinder in phantom, and, FIG. 5 is an enlarged side elevation of the tailgate cylinder and locking mechanism, showing a second position thereof in phantom.

As will be seen from FIGS. 1 and 4, when the ram is in its retracted (forward) position, the respective cylinders 30—30 are swung partially into their cylinder recesses within the bridge member.

When the ram member is extended in its packing position (FIG. 2), the cylinders 30—30 swing out of their respective recesses, to extend the ram for compacting refuse.

The two cylinders 30 will be seen to comprise standard single stage cylinders of well known design. Such cylinders can be specified to provide the range of force required for adequate compacting of refuse. Thus they perform in an efficient economical manner when compacting action is required, thereby minimizing fuel consumption and engine wear. In addition, since such cylinders are of a simple design, an adequate working life can be reasonably expected, bearing in mind that the compacting function is performed several hundred times in an average working day. In the event that one of the cylinders fails, then the replacement of it is not a major expense, and facilities are available in many locations for carrying out such work.

The ram 22 will be seen to be supported on a generally vertical ram support frame 56, having two lower frame legs 58 extending downwardly in defining therebetween an open space. In this way, the cylinders 30-30 are free to swing in a criss-cross fashion, within the open space between the legs 58.

Figure 2:
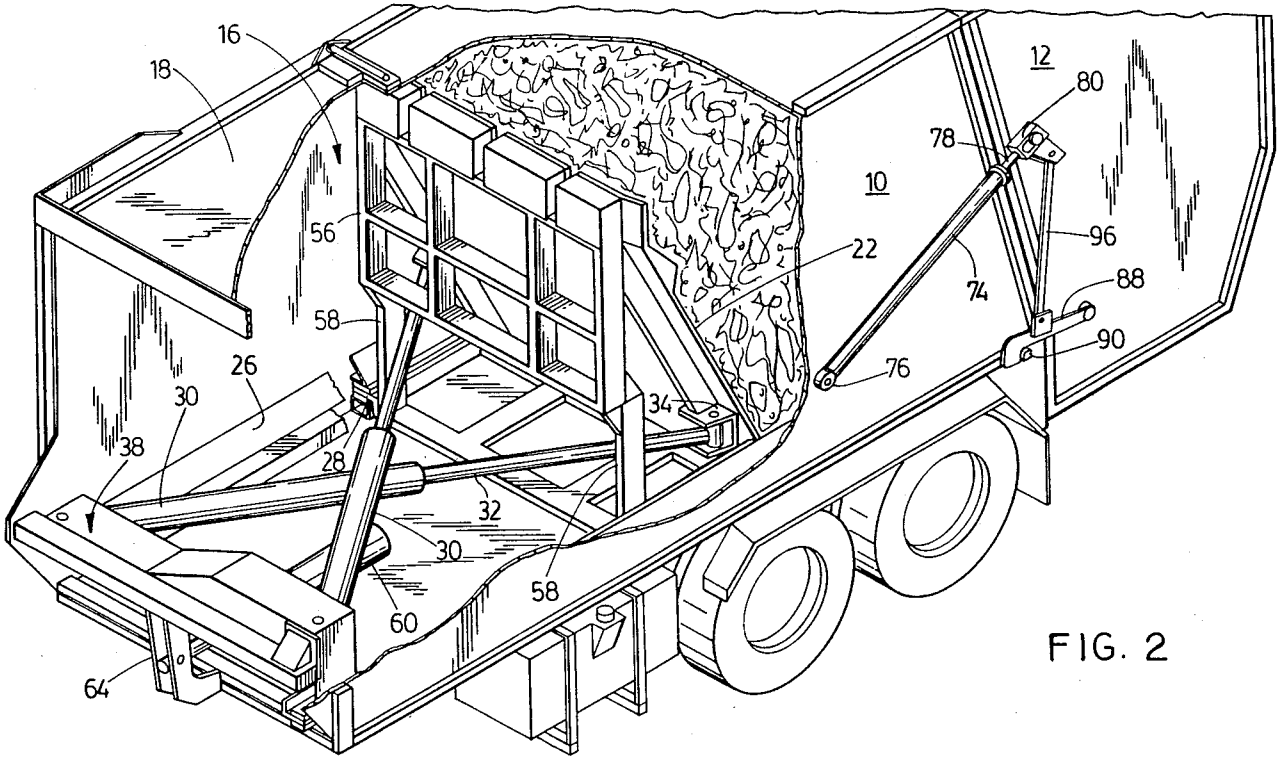
FIG. 2 is an upper front perspective of the vehicle refuse body, with the ram membmer in a rearward, compacting position.

The two cylinders 30-30 define a packing or ram stroke of predetermined length, and in its fully extended packing position, the ram will be located substantially in the position shown in FIG. 2. In this position, the top of the ram has just passed rearwardly of the opening 16.

It will thus be obvious that the length of the packing stroke itself is not sufficient for ejection of the load, when the vehicle is taken to the dump.

Figure 3:
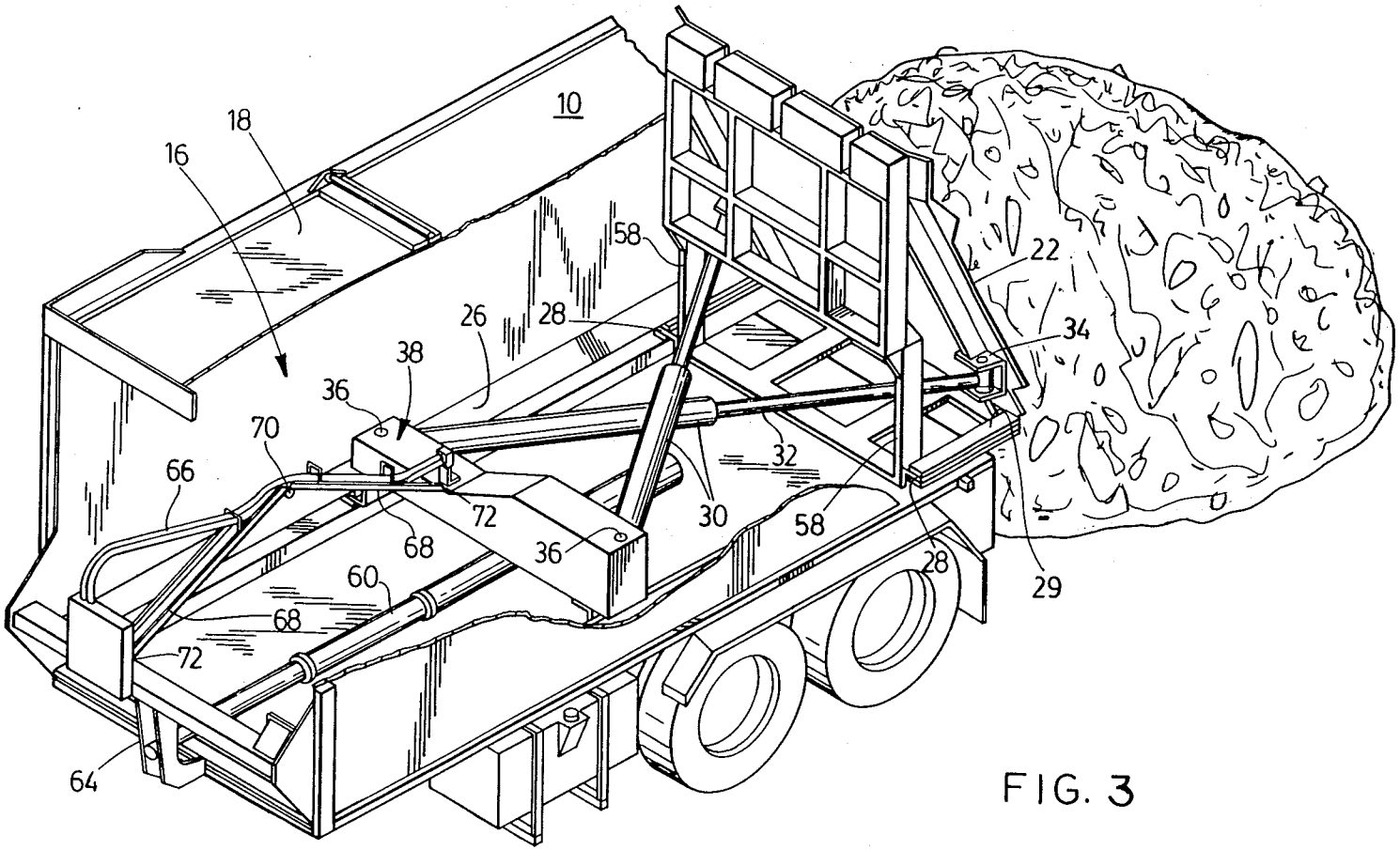
FIG. 3 is an upper perspective illustration corresponding to FIG. 2, showing the ram member in a rearward ejecting position.

In order to achieve ejection, the bridge 38 is itself moved rearwardly, into the position shown in FIG. 3, by means of a three-part telescopic cylinder 60. At the forward end of the main body, the piston rod 62 of cylinder 60 is fastened to any suitable part of the fabric indicated by the flanges 64.

The rearward end of cylinder 60 is attached by bracket 65 to bridge 38.

Operation of cylinder 60 into the position shown in FIG. 3, thereby causes the bridge itself to move rearwardly through the main body. This movement is carried out, with the two cylinders 30—30 fully extended, and this then causes the ram 22 to reach the rear end of the vehicle, and thus dump the contents.

In order to provide hydraulic power to the two cylinders 30—30, hydraulic supply and return hoses 66 are provided. Hoses 66 are flexible hoses, and in order to control their movement, and keep them out of the way, a scissors-like support 68—68 is provided, the two parts of which are hinged together at 70, and are also hinged at each end as at 72 to respectively the forward end of the main body, and the bridge 38.

In this way, as the bridge 38 slides to and from, the position of the hoses 66 is controlled at all times, away from the other mechanism, so that they cannot be damaged.

Figure 5:
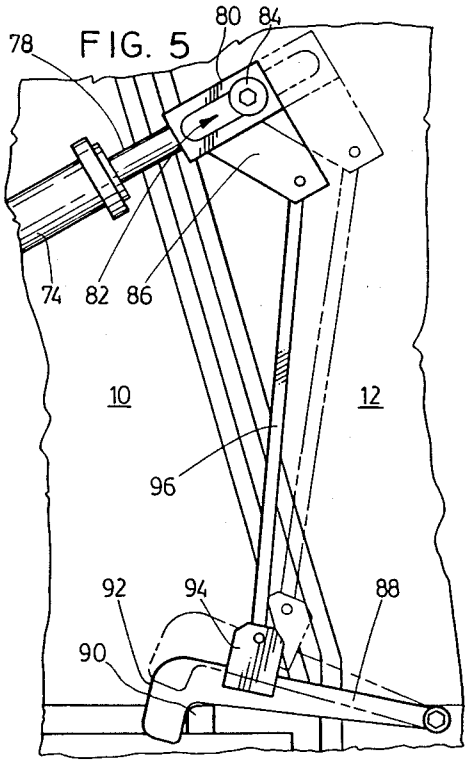

In order to raise and lower the tail gate portion 12, a pair of tail gate cylinders 74 are provided one on either side of main body 10, being swingably mounted thereon by means of flanges 76. Cylinders 74 have piston rods 78, provided at their free ends with a thrust member 80. Thrust member 80 has an elongated slot 82 formed therein (FIG. 5). Slot 82 receives a thrust pin 84, which is secured on tail gate 12.

Slot 82 thus provides a predetermined length of "lost motion" during which the piston 78 will extend, but the tail gate 12 will remain in position.

Attached to thrust member 80, is a mounting bracket 86.

In order to lock the tail gate 12 securely closed during packing, and during movement of the vehicle, a generally L-shaped locking arm 88 is swingably mounted on tail gate 12. A locking pin 90 is mounted on main body 10, and is engaged by the L-shaped free end 92 of locking arm 88.

A mounting bracket 94 is attached to locking arm 88. A connecting link 96 extends between bracket 94 and bracket 86, being swingable mounted at both ends.

Thus when the piston rod 78 is extended from cylinder 74, it will first of all cause thrust member 80 to slide relative to pin 84, for the length of the slot 82. This motion takes place without any lifting moment being applied to tail gate portion 12.

As is shown in the phantom portion of FIG. 5, this lost motion movement causes link 96 to raise on 88, thus clearing locking pin 90.

The tail gate portion 12 is thus unsecured and is now free to be raised. Continued operation of piston rod 78 will thus, through engagement with pin 84, raise the tail gate 12 as desired.

Clearly the reverse sequence of movements will first of all cause the tail gate 12 to swing downwardly, and will then cause the latch or lock 88 to close on the pin 90 thus securing the tail gate 12 in position.

It will of course be appreciated that these operations take place simultaneously on both sides of the tail gate, only one side being illustrated here for the sake of clarity.

The operation of the refuse vehicle is self-evident. At each pickup point a container (not shown) of refuse is picked up by the front end loading mechanism, the door 18 is opened by the cylinder 20, and the contents of the container are dumped into the hopper or main body 10.

During this function, the ram 22 is in its forward most (retracted) position as shown in FIG. 1.

The cylinders 30—30 are then operated so as to cause the ram 22 to cycle to and fro several times. In this way the refuse is pushed towards the rear of the main body 10.

As refuse accumulates at each pick-up point so the operation of the ram 22 will cause increasing compaction of the refuse. As noted above, the ram 22 may in fact be operated several times at each pickup point, and may well be operated several hundred times during a full day's operation.

During all of this time the bridge member 38 remains in its forward (retracted) position, and the telescopic cylinder 60 is inoperative.

When the main body and tail gate are full of compacted refuse, and no more can be added, the vehicle is driven to a dump site. At this point the tail gate cylinders 74 are then operated so as to first of all unlatch the tail gate locks 88, and then to raise the tail gate 12.

Raising of the tail gate 12 will of course dump a first portion of the contents already present in the tail gate 12.

The operator will then operate cylinders 30, thereby causing the ram 22 to be extended and this will then dump a further quantity of refuse from the main body 10.

The operator will then operate the telescopic cylinder 60, thereby extending the bridge 38 away from the forward portion of the main body, and this will then cause ejection of the remaining quantity of refuse.

Cylinders 60, and 30—30 may then be operated to retract the ram, and cylinders 74 may then be operated so as to lower, and lock the tail gate 12.

The vehicle is then ready to be driven away to collect a further series of loads.

The foregoing is a description of a preferred embodiment of the invention which is given here by way of example only. The invention is not to be taken as limited to any of the specific features described, but comprehends all such variations thereof as come within the scope of the appended claims.

What is claimed is

1. A refuse vehicle body of the type having a generally rectangular main body, a tailgate body portion which may be raised to eject the contents, and a forward opening in the main body through which refuse may be dumped, and a ram member moveable through said main body, from said forward opening to said tailgate, for compacting refuse, and for subsequently ejecting refuse from said main body and being characterized by;

a moveable bridge member of hollow multi-wall construction extending from side to side of said main body;

slide means in said main body for cooperation with said bridge member, for permitting sliding movement of said bridge member along said main body between a forward compacting position and a rearward ejecting position;

left and right hand compacting cylinders connecting diagonally across said main body, with respective left and right hand corners of said ram member, and said right and left hand cylinders being pivotally mounted to said bridge member and to said ram member, whereby said cylinders being operable to move said ram member relative to said bridge member along said main body for compacting refuse in said main body and said tailgate portion;

cylinder storage recess means formed in said bridge member for receiving portions of said right and left hand cylinders when said ram member is in its retracted position, said cylinder storage recess means including a lower wall, side walls, an intermediate wall, and a top wall, and wherein said lower wall and said intermediate wall define a first storage recess for one of said right and left cylinders, and wherein said intermediate wall and said top wall define a second storage recess for the other of said right and left cylinders; and, ejection cylinder means connected to a forward portion of said main body, and to said bridge member, for moving said bridge member away from said forward portion of said main body towards said tailgate portion, for ejecting contents from said main body.

2. A refuse vehicle body as claimed in claim 1 wherein said ejection cylinder means comprises a multi-cylinder telescopic cylinder mounted centrally, along a central axis of said main body, and operable to extend said bridge member towards said tailgate portion, for ejection of refuse.

3. A refuse vehicle body as claimed in claim 1 including flexible hydraulic hose means connecting with said compacting cylinders, and including hose support means defining at least two hose support portions hingedly connected to one another, and to said bridge member, whereby to provide a moveable support means for said flexible hoses during movement of said bridge member.

4. A refuse vehicle body as claimed in claim 1 including tailgate cylinders, operable to raise and lower said tailgate portion relative to said main body, locking abutments on said main body, and locking arm means swingably mounted on said tailgate portion and moveable into and out of locking engagement with said locking abutments, and linkage means swingably connected to said locking arm means and swingably connected to said tailgate cylinders, for raising and lowering said locking arm means in unison with operation of said tailgate cylinders.

5. A refuse vehicle body as claimed in claim 4 including piston rod means extending from said tail gate cylinders, connection plate means on said piston rod means, and elongated opening means formed therein, and boss means formed on said tailgate, and sliding within elongated opening, whereby to provide a lost motion connection between said pistons and said boss means.

* * * * *